US005744236A

United States Patent [19]

Rohrbach et al.

[11] Patent Number: 5,744,236

[45] Date of Patent: Apr. 28, 1998

[54] HOLLOW FIBERS IMPREGNATED WITH SOLID PARTICLES

[75] Inventors: Ronald P. Rohrbach, Flemington Hunterdon, N.J.; Gordon W. Jones, Toledo, Ohio; Peter D. Unger, Convent Station, N.J.; Daniel Bause, Flanders, N.J.; Lixin Xue, Morristown, N.J.; Russell Dondero, North Arlington, N.J.

[73] Assignee: AlliedSignal Inc., Morristown, N.J.

[21] Appl. No.: 758,039

[22] Filed: Nov. 27, 1996

[51] Int. Cl.[6] ..... D02G 3/00

[52] U.S. Cl. ..... 428/372; 428/364; 428/397; 428/398; 428/399; 442/337; 442/338; 442/417; 264/177.13

[58] Field of Search ..... 428/372, 398, 428/397, 364, 399; 55/522, 527, 528; 210/500.21, 500.23, 506, 562.1; 264/177.13; 442/337, 338, 417

[56] References Cited

U.S. PATENT DOCUMENTS 4,362,677 12/1982 Yamashita et al. ..... 428/398

5,057,368 10/1991 Largman et al. .

OTHER PUBLICATIONS

"Effect of particulate matter on mass transfer through microporous hollow fiber membranes"; Pakala et al; Jour. of Membrane Science; vol. 111, Mar. 1997, pp. 71–79.

"Novel Sorbent Yarns and Fabrics Containing Active Carbon", Arons; Textile Chemist and Colorist; vol. 11, Jan. 1979, pp. 24–27.

*Primary Examiner*—Marion E. McCamish
*Assistant Examiner*—J. M. Gray
*Attorney, Agent, or Firm*—Howard G. Massung

[57] ABSTRACT

A nonwoven filter media or mat (10) formed from a plurality of elongated generally hollow fibers (20) each having an internal cavity (22) which has an opening (24), smaller than the cavity width, to the fiber (20) surface and each retaining within the internal cavity (22) a large number of relatively small solid particles (18). The small solid particles (18), which can be an adsorbent such as activated carbon, are permanently entrapped within the longitudinal cavities (22) of the fibers (20) without the use of an adhesive.

11 Claims, 3 Drawing Sheets

HOLLOW FIBERS IMPREGNATED WITH SOLID PARTICLES

BACKGROUND OF THE INVENTION

1. Field of the Invention

This invention relates to fibers and more particularly to hollow fibers which permanently retain in their interior small solid particles, such as active carbon powder.

2. Description of Prior Art

In the prior art fibers have had surface coatings ranging from finely divided powder particles to coarse granular particles. The particles have been applied by either an adhesive coating which mechanically retains the particles on the fiber or the powder particles have been embedded on the fiber surface during the tacky stage in the polymer processing.

It is known to use carbon fibers for filter applications. The carbon fibers are formed from organic polymer fibers which are heated and carbonized. The carbon fiber can also be formed by heating polymer fibers and attaching carbon particles when the polymer is sticky or by using an adhesive to hold the carbon particles to a fiber. The ability to coat various powdered particulate material on a surface of a fiber has generally required an adhesive layer to be used to immobilize and hold the powder particles on the fiber surface. The very act of using an adhesive layer to hold the particles results in a portion of the surface of the powder particles being contaminated by the adhesive and therefore becoming ineffective for applications such as filtration. A balance has to be met between the strength of the immobilization versus the maintaining of effectiveness of the powder layer.

In order to minimize this contamination typically larger particles are often used so that the point of contact between the surface adhesive and powder particles is small. In typical gaseous applications using activated carbon the particles used are most frequently 100 microns and larger; and, finely powdered activated carbon is basically only used in liquid decolorization applications despite the fact that fine powder activated carbon holds the potential of much more rapid kinetics.

SUMMARY OF THE INVENTION

The present invention provides a flexible fiber wherein a solid particle, such as an activated carbon powder, is entrapped, without the use of an adhesive, within longitudinal cavities formed in the fiber. A plurality of the fibers are formed into a mat. The fibers have longitudinal extending internal cavities which have openings extending to the outer surface of the fibers. The fiber, the opening size and the particles to be entrapped are selected so that when the particles are forced into the longitudinal cavities they are permanently retained. The fibers selected provide a way to mechanically immobilize powdered activated carbon adsorbent particles without the use of an adhesive. The activated carbon powder becomes mechanically trapped within the longitudinal cavities of the fibers and is basically irreversible bound. This approach can be extended to any powder which one would like to entrap within a fiber medium, including such agents as zeolites, baking soda, cyclodextrins or any number of other solid particle of interest.

This invention provides flexible fibers, each having a cross section with internal cavities having openings leading to the surface of the fiber, which are impregnated with solid particles. The internal cavities extend longitudinal along the lengthwise direction of the fiber and they are filled with a solid particulate material which is permanently retained in the cavities and will not spill out through the openings due, we believe, to mechanical restrictions. The fibers are dusted with the solid particles and then rolled, forcing the particles into the fiber cavities. The excess particles are physically removed by agitation and a strong air flow. The particles entrapped in the cavities are surprisingly stable and resistant to physical action. The present invention should have a significant cost savings over carbon fibers and should outperform fibers coated with granular activated carbon.

BRIEF DESCRIPTION OF DRAWINGS

For a better understanding of the invention reference may be had to the preferred embodiments exemplary of the inventions shown in the accompanying drawings in which.

DETAILED DESCRIPTION OF THE PREFERRED EMBODIMENTS

Figure 1:
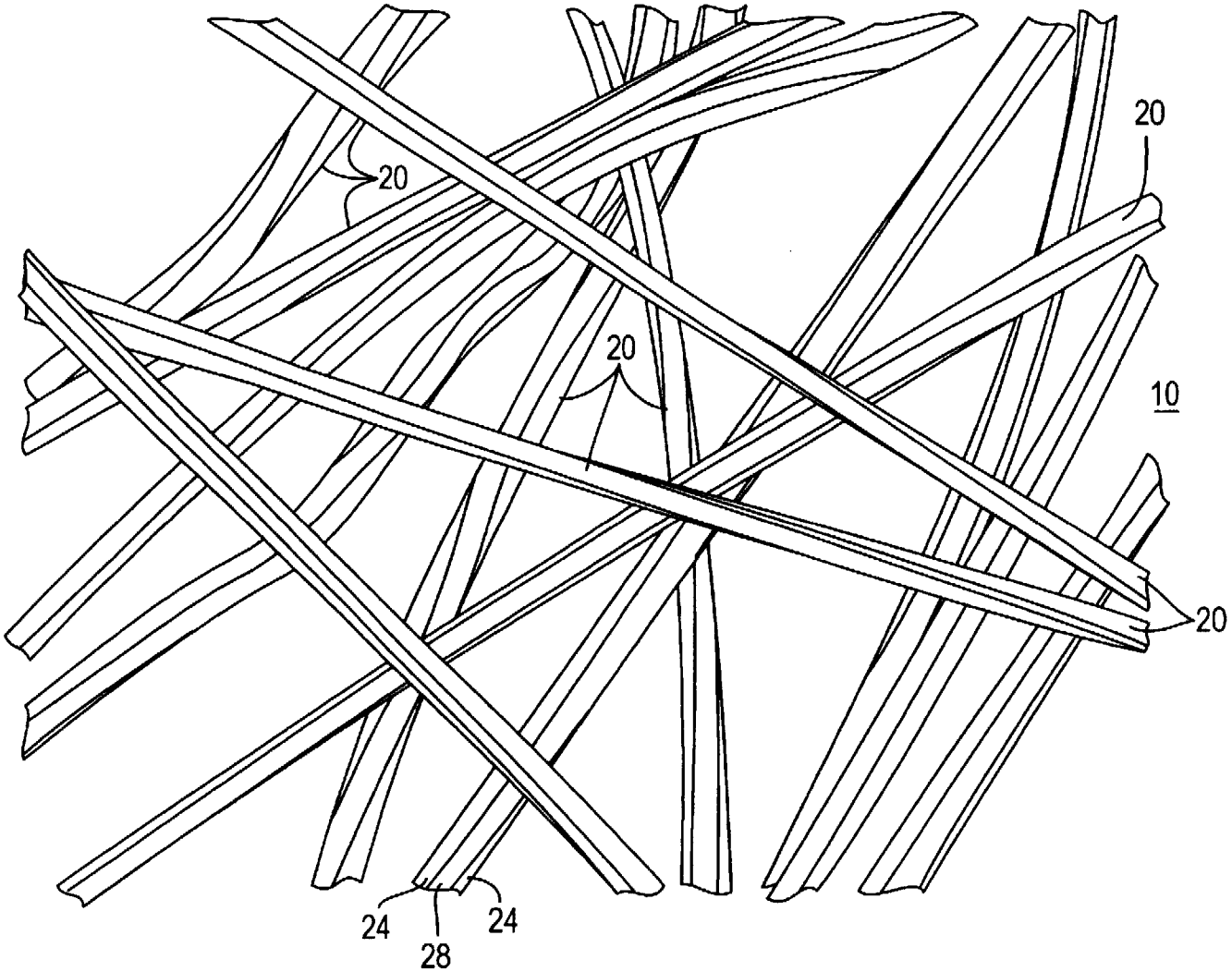
FIG. 1 is an illustration of a portion of a nonwoven fiber mat utilizing fibers containing carbon particles according to the present invention.
Figure 2:
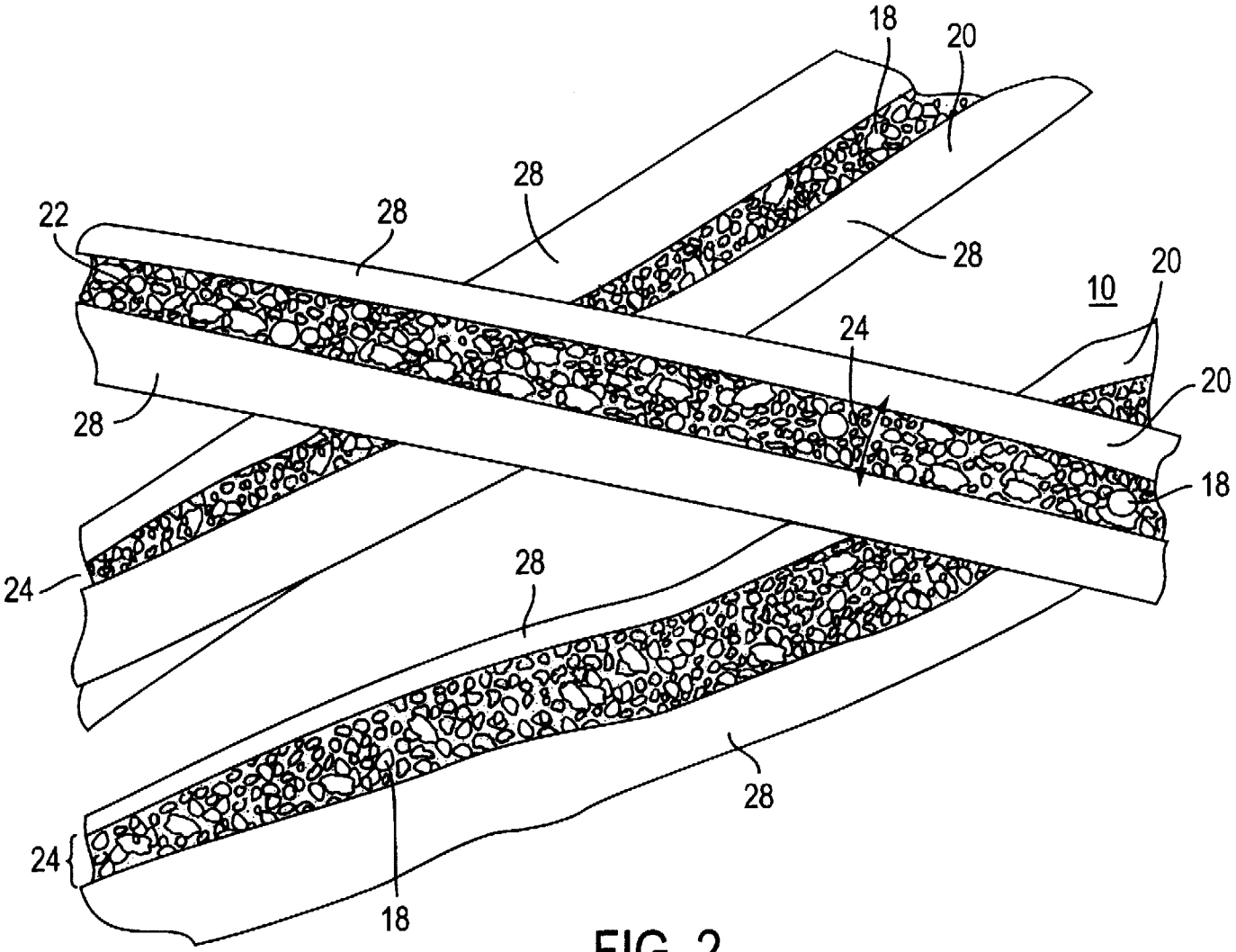
FIG. 2 is an enlarger view of a portion of the fiber mat shown in FIG. 1 utilizing fibers according to the present invention; and, FIG. 3 is a perspective view showing a fiber which is suitable for practicing the present invention.

Referring now to the drawings and FIGS. 1 and 2 in particular there is shown a fiber mat 10 formed from a plurality of flexible fibers 20. The flexible fibers 20 are formed into the nonwoven fiber mat 10 which can be used as a filter. Each fiber 20 includes an internal cavity 22 within which are disposed small dry active carbon particles 18. A longitudinal opening 24 extends from each cavity 22 to the surface of each fiber 20. The multilobal fibers 20 are relatively small having a diameter of 250 microns to 10 microns or smaller. The fibers shown in FIGS. 1 and 2 are approximately 30 microns in diameter. The size of opening 24 is selected so when particles 18 are disposed in cavity 22 they are generally permanently entrapped and cannot easily be removed. The active carbon particles 18 are very small generally being less than 1 or 2 microns across.

The small carbon particles 18 become mechanically entrapped and remain within the fiber cavities 22 and generally do not enter the space between the fibers 20; yet, through the longitudinal openings 24 the particles 18 are in communication with the fluid or air stream flowing past the generally hollow fibers 20 during a filtering application.

In an odor removal use, the gas adsorbing active carbon particles 18 which have an affinity for the undesired gases to be removed from the air stream are selected and disposed within the internal channels or cavities 22 formed in the individual generally hollow fibers 20. The particles selected use adsorption rather than absorption as the mechanism to decontaminate or remove odor from the air stream. The particles 18 used are selected to adsorb the vapors of interest, to be non hazardous and to neutralize or remove specific gases and odor vapors.

Figure 3:
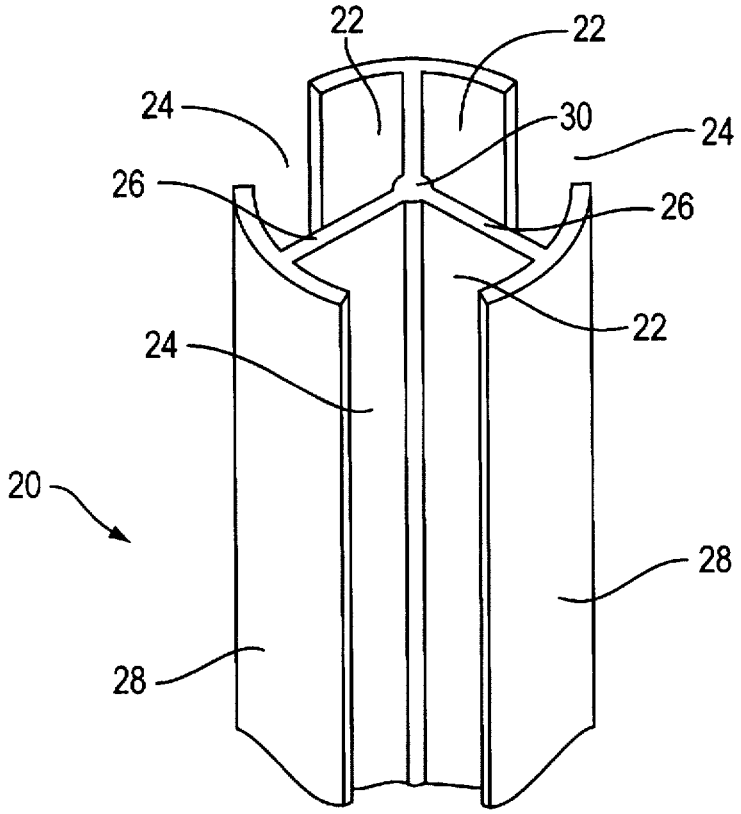

A generally hollow fiber 20 which is suitable for practicing this invention is disclosed in U.S. Pat. No. 5,057,368 and is shown in FIG. 3. This patent discloses a trilobal or quadrilobal fiber formed from thermoplastic polymers wherein the fiber has a cross-section with a central core and three or four T-shaped lobes 26. The legs of the lobes intersect at the core 30 so that the angle between the legs of adjacent lobes is from about 80 degrees to 130 degrees. The thermoplastic polymer is typically a polyamide, a polyester, a polyolefin or a combination thereof. The fiber 20 as illustrated in FIG. 3 is formed as an extruded strand having three hollow interior longitudinally extending cavities 22 each of which communicates with the outer strand surface by way of longitudinal extending slots 24 which are defined between the outer ends of the T-shaped lobes.

As can be clearly seen in FIGS. 1 and 2 the active carbon particles 18 are retained within the individual cavities 22 without spilling out into the inter fiber voids. The fibers 20 strongly retain the active carbon particles 18 within the cavities 22 so that the particles 18 will not shake off and the fiber mat 10 retains the particles 18 when touched or handled. In a filter mat 10 of such fibers 20 the area between the individual strands remains relatively free of the gas adsorbing active carbon particles 18 with which the internal cavities 22 of each fiber 20 are filled. The filter mat 10 fibers 20 may be made of one or more types of material such as polyamides, polyesters, or polyolefins. The three T-shaped cross-section segments 26 may have their outer surface 28 curved, as shown, or the outer surface may also be straight. While the fiber 20 is depicted as three lobed other number of lobes are suitable. In addition other internal cavity fibers with C-shapes or other cross sections may also be suitable for retaining the small gas adsorbing particles 18 provided the opening from the cavity is sized to retain the particles 18 within the fiber interior.

In forming the fiber mat 10, the solid particles are aggressively rubbed into the fibers 20. The procedure used for dry impregnation is to take the fibers 20 and liberally dust them with the adsorbent powder. The particles 18 of the adsorbent powder have a diameter of less the one half the fiber 20 cross sectional diameter. The powder particles 18 are rolled into the fiber 20 several times. The excess powder is physically removed by agitation aided by a strong air flow. The powder particles 18 which remain within the cavities 22 are surprisingly stable and resistant to physical action. We believe it is a keystone type mechanical entrapment effect which so tenaciously hold the particles 18 within the fibers 20. The particles 18 seem to engage one another and do not spill from the cavities 22 through opening 24. We tried impregnating trilobal fiber in which the outer ends or caps of the lobes 26 were removed. Very little carbon particles were retained by such fibers.

In order to determine the cause of the forces responsible for this surprisingly strong interaction between the fibers 20 and the fine powder particles 18 we attempted to reduce the electrostatic bonding forces, if any, which might have caused this tenacious agglomeration. We first subjected the impregnated carbon fibers to 100% relative humidity and directed 40 meters per minute of air over the fibers 20 and collected any off dust. We found undetectable amounts. We further took the fiber filter mat 10 and submerged it into room temperature water with agitation and found the carbon particles 18 still remained securely in place. Then we took the filter fiber mat 10 and added detergent to the water with agitation and found no further loss. Additionally the carbon impregnated fibers 20 withstood both an alcohol and acetone wash without loss of carbon particles 18. These tests clearly indicate that the forces responsible for this interaction are non electrostatic in nature and suggest a mechanical entrapment. These tests also indicate the fibers 20, impregnated with activated carbon or other particles, might have applications for various fluid media including gas and liquids.

The disclosed approach can be extended to any powder which one would like to entrap within a fiber medium, including such agents as zeolites, baking soda, cyclodextrins or any number of other solid particle of interest. The fibers 20 have also been used to entrap particles of zinc oxide, zirconium oxide, silica, alumina in various phases, clays including kaolin and bentonite. In the fibers 20 shown in FIGS. 1 and 2 the fiber diameter is around 30 microns. The size of the cavity 22 opening 24 is approximately 10 microns. The carbon particles are around 1 to 2 microns across and smaller.

The material described in this invention can be surface coated with virtually complete retention of the powder's properties and can be extended to be used with extremely fine powders. By so doing one can significantly improve the performance and efficiency of the powder. In the case of activated carbon, typical gaseous applications use larger granular carbon particles and finely powdered activated carbon is basically only used in liquid decolorization applications despite the fact that powder activated carbon holds the potential of much more rapid gas kinetics. With this invention filters can be constructed utilizing finely powdered activated carbon for gas phase applications. Additionally, this invention can also be used for liquid based applications.

Basically, one application of this invention provides a simplified and low cost version of a carbon fiber element. Instead of starting with an organic polymer which is then heated and carbonized or to which carbon particles are glued we start with a generally hollow fiber and impregnate it with powdered carbon. While this invention has been described using carbon particles other powders formed of organic particles or inorganic particles, which are within the required size range, can be used. A few other examples of uses for the invention are: an odor control carbon filter; a zeolite coated odor control filter; and a metal sequestering water filter.

We claim:

1. A fiber mat comprising:

a plurality of elongated fibers each having a longitudinally extending internal cavity including an opening from the internal cavity to the outer fiber surface which extends longitudinally along the surface of the fiber;

a fine powder made from particles which are smaller than the opening disposed within the internal cavities of said plurality of elongated fibers; and, said fine powder particles being of such a size, shape and makeup that they are securely retained within the internal cavity.

2. The fiber mat as claimed in claim 1 wherein each elongated fiber is less than 250 microns in diameter and the majority of fine powder particles are less than 20 microns in size and the opening from the internal cavity to the outer fiber surface is elongated and has a width which is less than three quarters but greater than one tenth of the elongated fiber diameter.

3. The fiber mat as claimed in claim 1 wherein the fine powder particles are activated carbon.

4. The fiber mat as claimed in claim 1 wherein a plurality of internal cavities, each including an opening to the outer fiber surface, are formed in each fiber; and, each opening is elongated and extends for essentially the length of its fiber.

5. A fiber comprising:

an elongated strand;

an internal cavity formed in said strand;

an elongated opening extending along the outer surface of said elongated strand and connecting said internal cavity to the outer surface of said elongated strand; and, a plurality of solid particles, the majority of which are smaller than one half of the width of the elongated opening, disposed and permanently retained within said internal cavity.

6. A fiber as claimed in claim 5 wherein the diameter of said elongated strand is less than 250 microns, the width of said elongated opening is less than one half the strand diameter but greater than one tenth of the strand diameter and the average diameter of said plurality of solid particles is less than 10 microns.

7. A method of manufacturing a fiber strand impregnated with solid particles comprising the steps of:

a. forming a fiber strand with an internal longitudinally extending cavity having a longitudinally extending opening, smaller across than the cavity width, from the cavity to the fiber strand outer surface;

b. applying a plurality of the solid particles to the strand;

c. forcing many of the solid particles through the longitudinally extending opening into the internal longitudinally extending cavity where they are securely retained; and, d. removing the excess of solid particles which are not retained in the internal longitudinally extending cavity from the outer surface of the strand.

8. A fiber mat comprising:

a plurality of elongated fibers each being formed from at least three T shaped portions, joined at their base at the center of the fiber, to define a plurality of longitudinally extending internal cavities with openings, formed between the outer ends of the T-shaped portions, to the outer fiber surface;

a fine powder made from particles which are smaller than the openings formed between the outer ends of the T-shaped portions disposed within the internal cavities of said plurality of elongated fibers; and, said fine powder particles being of such a size, shape and makeup that they are securely retained within the internal cavity.

9. A fiber mat as claimed in claim 8 wherein each elongated fiber is less than 250 microns in diameter and the majority of fine powder particles are less than 20 microns in size.

10. A fiber mat as claimed in claim 9 wherein the fine powder particles are activated carbon.

11. A fiber mat as claimed in claim 8 wherein the openings, formed between the outer ends of the T-shaped portions, to the outer fiber surface extend the length of the fiber.

* * * * *